US005391050A

United States Patent [19]

Gatteschi

[11] Patent Number: 5,391,050

[45] Date of Patent: Feb. 21, 1995

[54] DEVICE FOR PICKING UP, MOVING AND DEPOSITING A PILE OF CARTON BLANKS

[75] Inventor: Emanuele Gatteschi, Parma, Italy

[73] Assignee: OCME S.r.l., Parma, Italy

[21] Appl. No.: 149,201

[22] Filed: Nov. 9, 1993

[30] Foreign Application Priority Data

Nov. 11, 1992 [IT] Italy ..... MI92 A 002576

[51] Int. Cl.[6] ..... B65G 59/02; B65H 3/24

[52] U.S. Cl. ..... 414/796; 414/796.6; 414/796.9; 414/744.3; 294/86.41; 294/119.1

[58] Field of Search ..... 414/796, 796.6, 796.9, 414/792.9, 744.3, 744.8; 294/86.4, 86.41, 103.1, 119.1

[56] References Cited

U.S. PATENT DOCUMENTS

| | | | |
|---|---|---|---|
| 4,621,852 | 11/1986 | Maki | 294/86.4 |
| 4,632,444 | 12/1986 | Martinez et al. | 294/86.4 |
| 5,017,085 | 5/1991 | Ishikawa | 414/796 |
| 5,040,942 | 8/1991 | Brinker et al. | 414/796.6 X |
| 5,042,862 | 8/1991 | Tübke | 294/86.4 |

FOREIGN PATENT DOCUMENTS

| | | | |
|---|---|---|---|
| 0363722 | 9/1989 | European Pat. Off. . | |
| 2313294 | 12/1976 | France . | |
| 3221351 | 12/1983 | Germany | 414/744.3 |
| 3612780 | 10/1987 | Germany . | |
| 4124077 | 1/1993 | Germany | 414/796.9 |
| 182577 | 7/1966 | U.S.S.R. | 294/86.4 |

*Primary Examiner*—Andres Kashnikow
*Assistant Examiner*—Lesley D. Morris
*Attorney, Agent, or Firm*—Hedman, Gibson & Costigan

[57] ABSTRACT

The device (1) for picking up, moving and depositing a pile (9) of carton blanks comprises an element (3) suitable for moving according to three Cartesian axes, and to cause to rotate on itself, according to a vertical axis (7), a clamping element (2) which comprises three movable plates (11-13) cooperating with a pressing element (14).

3 Claims, 5 Drawing Sheets

DEVICE FOR PICKING UP, MOVING AND DEPOSITING A PILE OF CARTON BLANKS

The present invention relates to a device for picking up, moving and depositing a pile of carton blanks.

The machines which package the product by means of cardboard boxes (usually referred to as "cartoning machines"), are provided with a magazine in which the blanks, arranged as a pile, remain waiting for being picked up and then bent in order to shape the relevant container.

At present, the periodical supply of the magazine is carried out by an attending operator which manually picks up a blank pile from a blank bearing pallet laid nearby the cartoning machine.

Unfortunately, the high production rate reached by the presently used cartoning machines causes a tendentiously burdensome working speed for the operator who may meet with difficulties in supplying the machine with the necessary continuity and frequency.

The purpose of the present invention is of obviating the above drawback, i.e. of providing a device which is capable of automatically supplying the magazine of a cartoning machine with the necessary continuity and frequency, leaving to the operator the less physically burdensome task of surveying and controlling the operations.

Such a purpose is achieved by a device according to the present invention.

The present invention is illustrated for merely exemplifying, non-limitative purposes, in the figures of the accompanying drawings.

Figure 1:
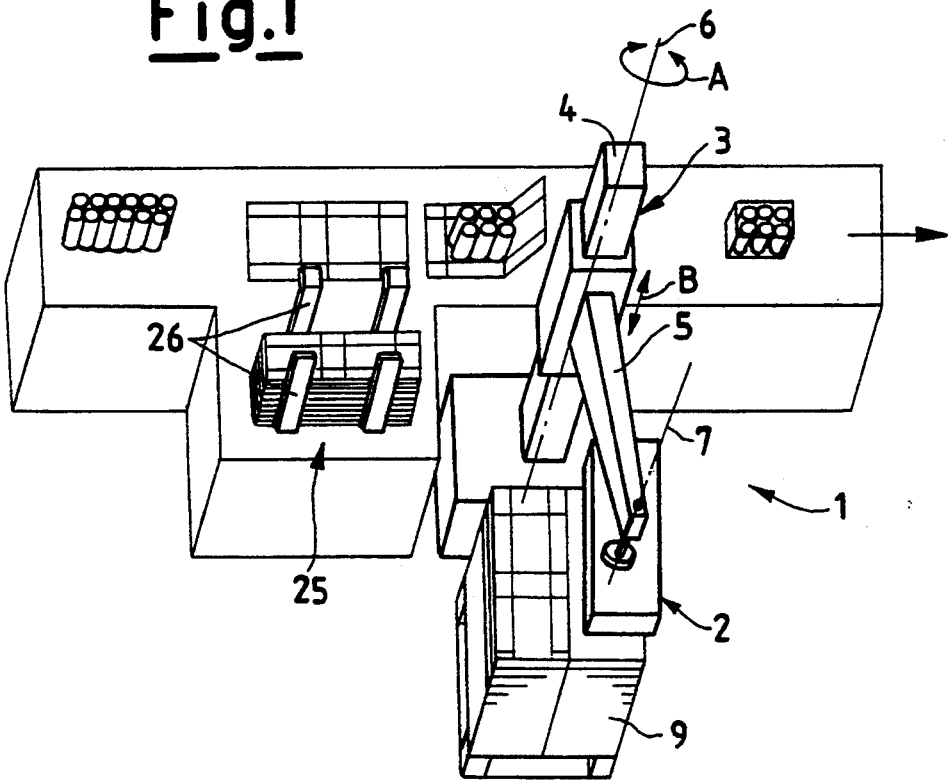
FIG. 1 is a top perspective view of a device according to the present invention, as applied to a packaging machine commonly referred to as "cartoning machine"
Figure 4:
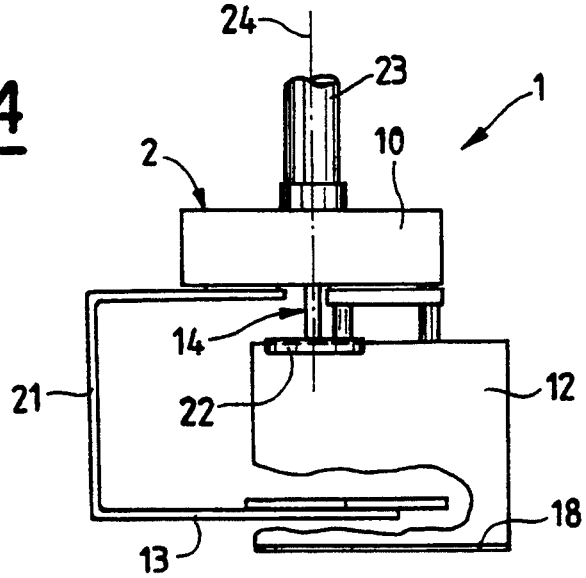
FIG. 4 is a side elevation view of the picking up element.
Figure 2:
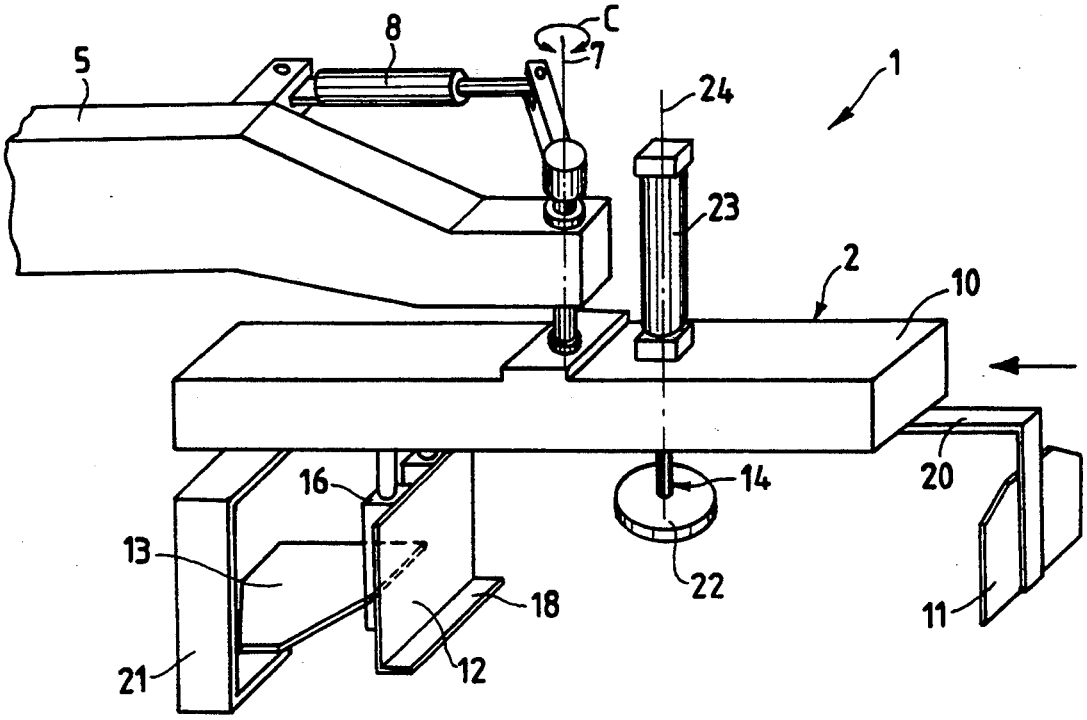
FIG. 2 is a perspective view of the picking up element of the device of FIG. 1.
Figure 3:
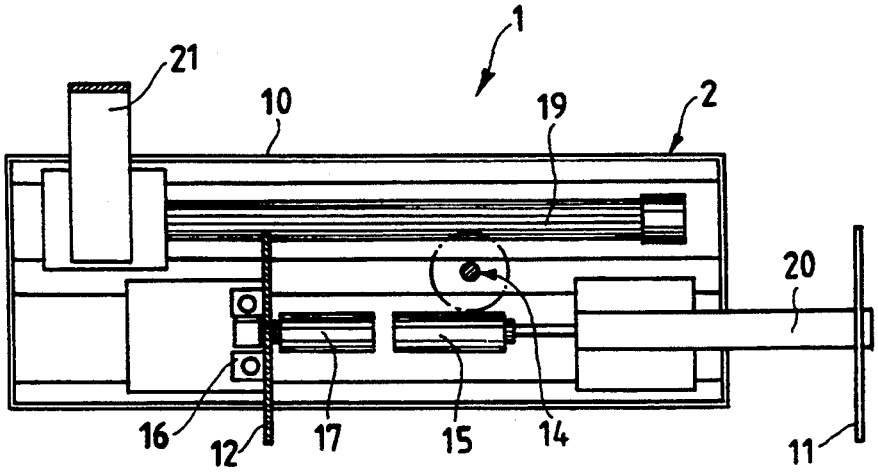
FIG. 3 is a bottom view of the picking up element.

Referring to the above mentioned figures, the device for picking up, moving and depositing a blank pile, generally indicated with (1), comprises a picking up element (2) for picking up the blanks and a moving element (3) for moving said picking up element.

In the particular embodiment illustrated herein, the element (3) comprises a vertical column or upright (4), and an arm (5) perpendicular to said upright.

The upright (4) is suitable for revolving around itself, around the vertical axis (6). The arm (5) is translatable along the vertical axis (6) of upright (4), shown as arrow B, and bears, hinged at one of its ends, the picking up element (2).

The picking up element (2) is rotatable, arrow "C", on itself, around a vertical axis (7) running through its bearing center (7), parallel to the axis (6), thanks to a first actuator cylinder (8).

In the overall, therefore, the picking up element (2) for picking up the blanks results to be mobile according to three Cartesian axes and rotatable around a vertical axis.

In such a way, it can be positioned in any points inside the free room which is within the reach of arm (5). Therefore, the moving element (3) can be positioned, with no particular constraints, in the nearby of the relevant cartoning machine. The moving element (3) may also have a different structure from as illustrated. For example, it might be replaced by a gantry or overhead travelling crane device, suitable for being translated possibly also above a plurality of cartoning machines.

The picking up element (2) for picking up the blanks arranged as a pile of blanks (9) substantially comprises a framework (10), a first mobile plate (11), a second mobile plate (12) and a third mobile plate (13) and a pressing element (14). The first plate (11) is arranged according to a vertical plane and can be moved perpendicularly to said vertical plane, by means of the action of a second actuator cylinder (15).

The second plate (12) is parallel to the first plate (11) and is movable both along its laying plane, and perpendicularly to the latter, by means of the action of a third, and, respectively, a fourth actuator cylinders (16) and (17), respectively.

Said second plate comprises, at its bottom edge, a horizontal portion (18), the function of which will become evident from the following.

The third plate (13) can slide under and along a plane perpendicular to the planes on which said first and second plates lay, owing to the action of a fifth actuator cylinder (19).

The plates (11) and (13) can be linked to their relevant actuator cylinder, as in the herein illustrated embodiment, by respective arms (20) and (21) which are shaped considering the outline of the blanks to be handled.

The pressing element (14) comprises a disk (22) fastened onto the end of the stem of a sixth actuator cylinder (23). The disk (22) results hence to be mobile ("arrow D") along a vertical axis (24) which is parallel to axis (7) and runs through the free room comprised between said first and second plates (11) and (12), respectively, so as to be capable of acting on the top end of the pile (9) of blanks, in opposition to said third plate (13).

The functional coordination of all of the elements which compose the device (1) is obtained by means of a central control unit, not illustrated herein, which is also provided with a keyboard which allows the operator to enter data which may be variable, or which vary as a function of the position of the picking up and discharging points.

Figure 5:
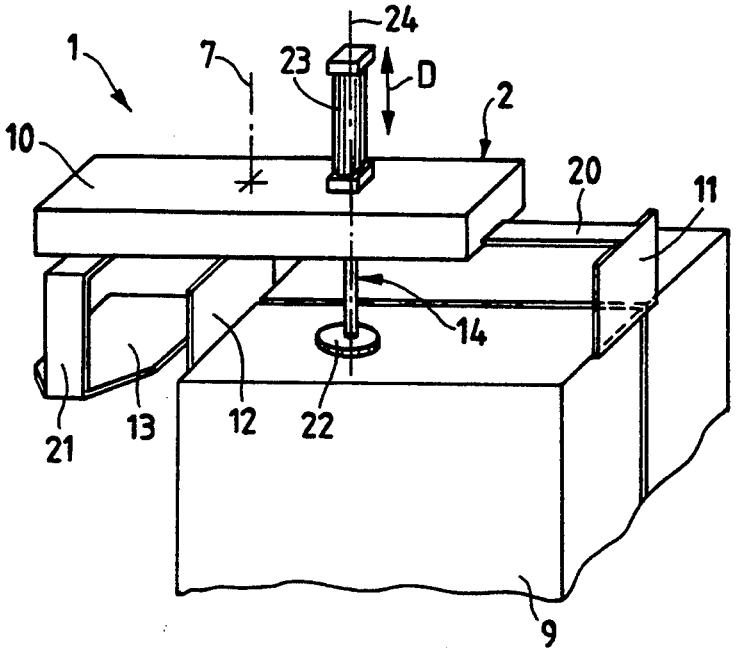
FIG. 5 is a perspective view of the picking up element at the time of its first contact with the blanks arranged on a wooden pallet, commonly known as "pallet"

The start command for the supply cycle is sent to the device (1) by the operator, or by a level sensor (photocell) installed in the magazine of the cartoning machine. The picking up element (2) is lowered on the blanks stored on the pallet, until the disk (22) of the pressing element (14) comes to rest against the first blank of the pile (FIG. 5). The picking up element (2) continues to move downwards, still owing to the translation of arm (5) according to arrow "B", down to a level "h" which equates the height of the pile of blank (9) to be picked up. The level "h" is one of those parameters which have to be entered at device programming time.

Figure 6:
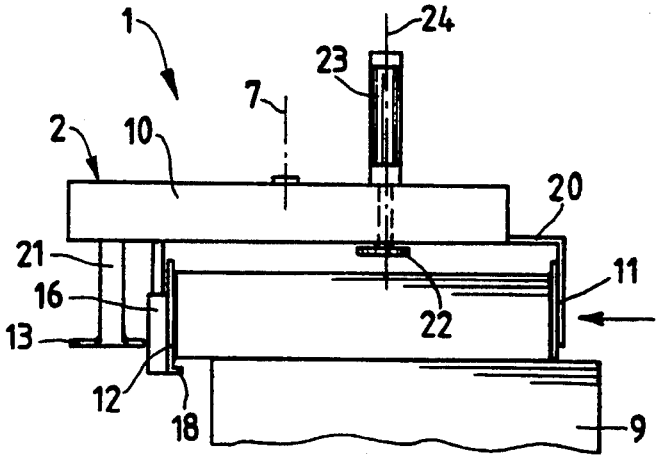
FIG. 6 is a front elevation view of the picking up element while it is separating the pile of blanks to be picked up, from the remaining ones.

The first plate (11) is shifted from its spaced apart position, i.e., its outermost position from framework (10), to its retracted position, i.e., its innermost position relatively to said framework (10), thus pushing the pile (9) of blanks to be picked up against the second plate (12) (FIG. 6), acting as a shoulder plane.

Figure 7:
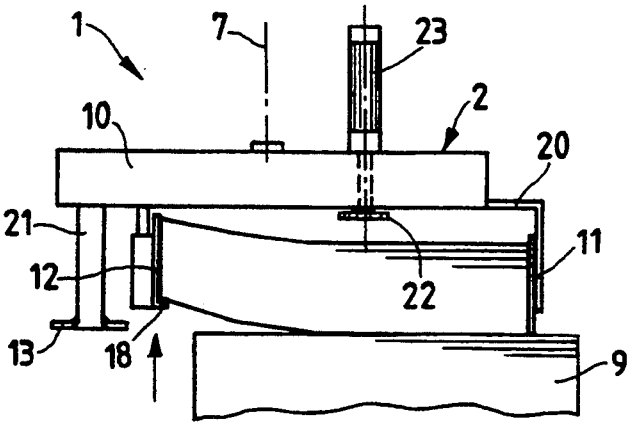
FIG. 7 is a front elevation view of the picking up element, while it is lifting an edge of the pile to be picked up.
Figure 8:
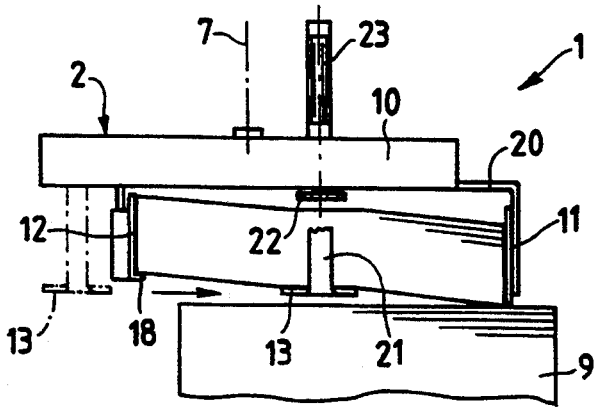
FIG. 8 illustrates the position taken by the picking up element during the picking up step, while one of its plates is being moved perpendicularly to the preceding ones and under said blank pile.
Figure 9:
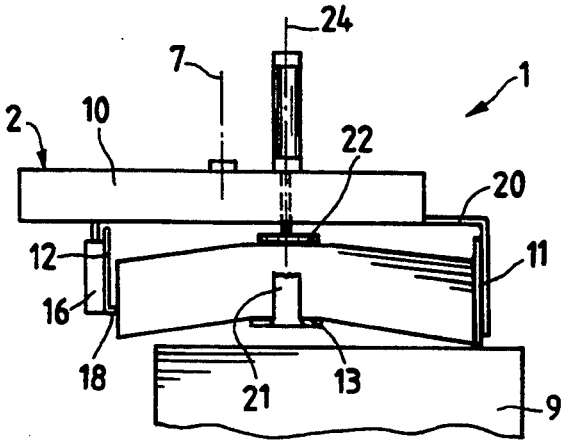
FIG. 9 illustrates the configuration taken by the picking up element during the initial step of lifting the picked up pile.

The second plate (12) is lifted (FIG. 7), consequently lifting, by the action of its flat portion (18), the bottom portion of the pile (9), so as to generate a free room through which the first plate (13) can be positioned, without uncertainties or interferences with the blanks, under the bottom side of said blanks pile and substantially in central position relatively to said pile (9) (FIG. 8), and opposite to the disk (22) of the pressing element which keeps the blanks pile (9) urged from above, thus clamping it (FIG. 9).

Figure 10:
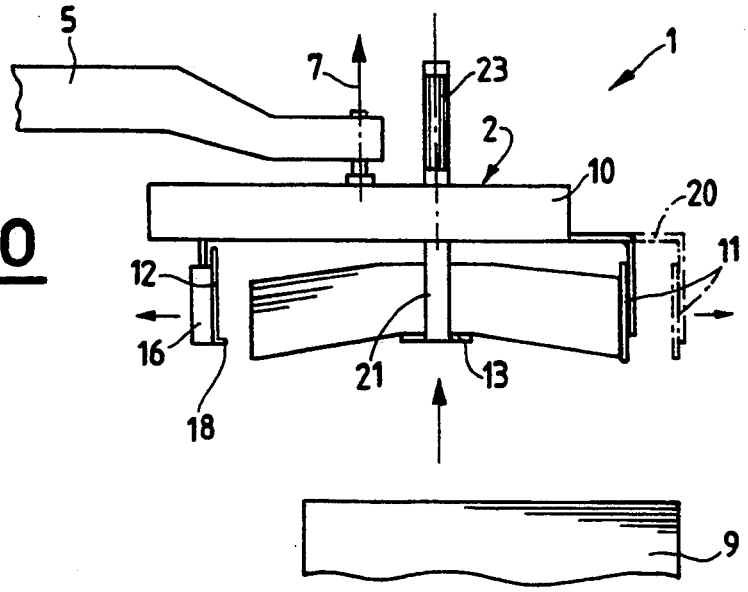
FIG. 10 illustrates the configuration taken by the picking up element during the step of shifting the pile retained by it.
Figure 11:
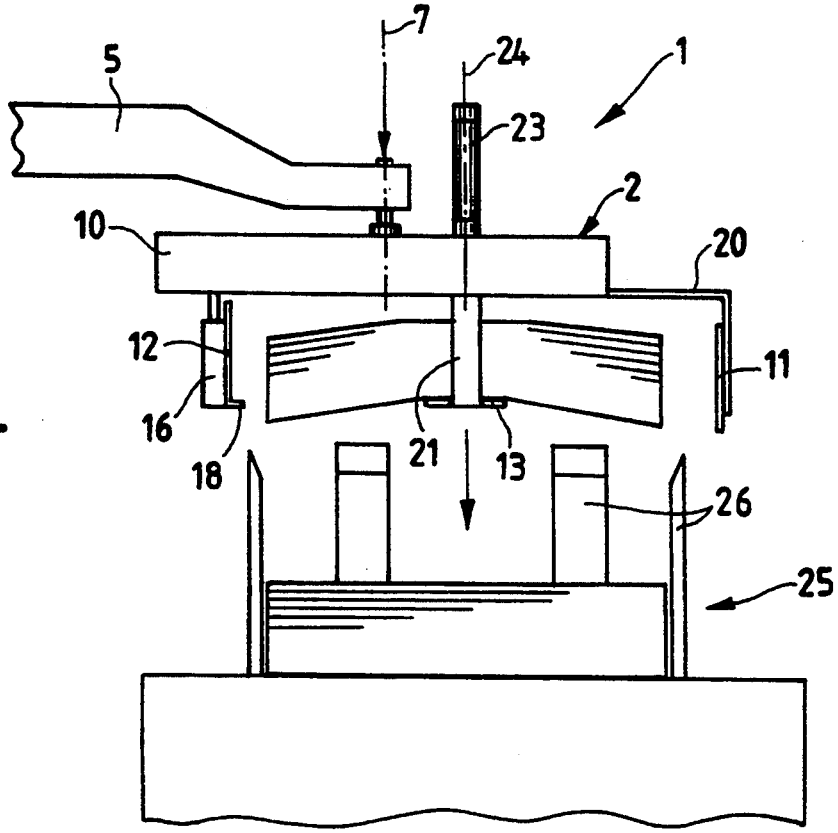
FIG. 11 illustrates the configuration taken by the picking up element during the deposition of the pile inside the machine magazine.
Figure 12:
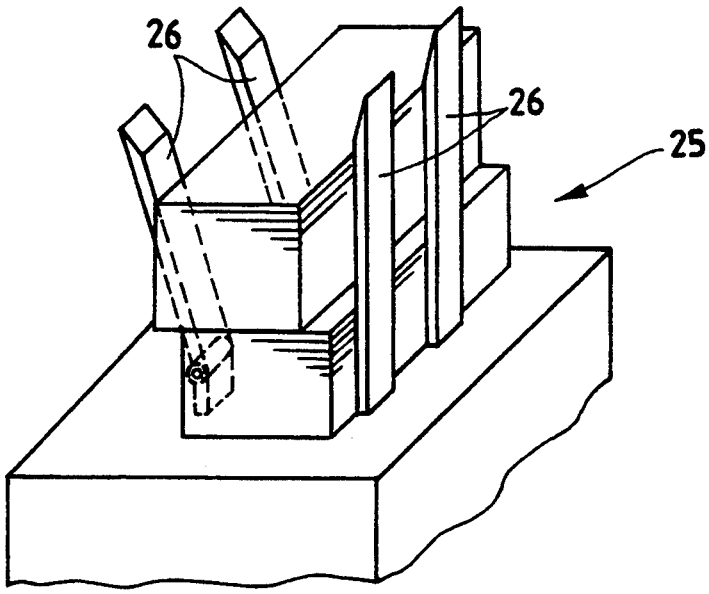
FIG. 12 illustrates the pile charged to the magazine.

The picking up element (2) is lifted and is shifted, thus transporting the pile of blanks (9) to a position thereof which is vertically aligned above the magazine of the cartoning machine. During said shift, the first and second plates (11) and (12), respectively, get spaced away from the framework (10) (FIG. 10) in order to prevent, if necessary, any possible interferences of said plates (11) and (12) with any stationary elements of the magazine (25) of the cartoning machine.

The pile (9) of carton blanks can be retained with high enough energy between the third plate (13) and the disk (22) of the pressing element (14).

When the picking up element (2) has reached its vertically aligned position above the magazine (25) of the cartoning machine, the picking up element (2) is lowered, arrow "B", so as to deposit the pile (9) above the pile of blanks which is going to be exhausted already present inside the magazine (25).

When the magazine (25) comprises a plurality of prongs (26), the third plate (13) can be simply slid off by revolving the upright (4) around its axis (6) and possibly revolving the picking up element (2) around the axis (7) (arrow "C"). When the third plate (13) is disengaged, the picking up element (2) is brought back to its starting point, ready to perform a new operation identical to the preceding one.

I claim:

1. A device (1) for picking up, moving and depositing a pile (9) of carton blanks, wherein said device comprises a picking up element (2) for picking up the blanks and an element (3) for moving said picking up element (2) according to three Cartesian axes and rotating said element (2), around a vertical axis (7), in which said picking up element (2) comprises a framework (10) supporting three movable plates (11–13) and a pressing element (14), in which:

the first plate (11) is arranged according to a vertical plane and is movable perpendicularly to it, the second plate (12) is parallel to the first one and is movable both according to its laying plane and perpendicularly to it, the third plate (13) is slidable under the along a plane perpendicular to said first (11) and second (12) plates, the pressing element (14) acts along a vertical axis (24) inside the free room comprised between said first (11) and second (12) plates.

2. The device according to claim 1, wherein in that said second plate (12) comprises, at its bottom edge, a flat portion (18) arranged perpendicularly to the laying plane of said second plate (12).

3. The device according to claim 1, wherein in that the element (3) for moving said picking up element (2) comprises a vertical shaft (4) which can be revolved around its axis, along which an arm (5) can slide, which is horizontally arranged and at whose end the picking up element (2) is provided.

* * * * *